United States Patent [19]

Kakihana

[11] Patent Number: 4,906,956

[45] Date of Patent: Mar. 6, 1990

[54] ON-CHIP TUNING FOR INTEGRATED CIRCUIT USING HEAT RESPONSIVE ELEMENT

[75] Inventor: Sanehiko Kakihana, San Francisco, Calif.

[73] Assignee: Menlo Industries, Inc., San Francisco, Calif.

[21] Appl. No.: 105,643

[22] Filed: Oct. 5, 1987

[51] Int. Cl.[4] ..... H01P 5/00; H01P 5/04

[52] U.S. Cl. ..... 333/246; 333/262; 333/263; 357/2

[58] Field of Search ..... 333/235, 205, 263, 262, 333/103, 104, 246; 357/2

[56] References Cited

U.S. PATENT DOCUMENTS

| | | | |
|---|---|---|---|
| 3,343,004 | 9/1967 | Ovshinsky | 357/2 X |
| 3,382,418 | 5/1968 | Jensen | 357/2 |
| 3,679,947 | 7/1972 | Chakraverty et al. | 357/2 |
| 3,796,976 | 3/1974 | Heng et al. | 333/246 X |
| 3,877,049 | 4/1975 | Buckley | 357/2 |
| 3,987,311 | 10/1976 | Thornburg | 357/2 X |
| 4,593,306 | 6/1986 | Marchant et al. | 357/2 X |
| 4,752,118 | 6/1988 | Johnson | 357/2 X |

FOREIGN PATENT DOCUMENTS

| | | | |
|---|---|---|---|
| 2548846 | 1/1985 | France | 333/202 |

OTHER PUBLICATIONS

Schuocker, Dieter; "Thermal Switching in Thin Glass Films Triggered by a Control Electro"; *Jour Applied Physicstl ; vol. 44, No. 1, pp. 310–313, Jan. 1973.*

Ravender Goyle, et al., "MMIC: On-Chip Tunability", Microwave Journal, Apr. 1987, pp. 135–139.

Dylan F. Williams, et al., "Adjustable Tuning for Planar Millimeter-Wave Circuits", International Journal of Infrared and Millimeter Waves, vol. 7, No. 11, 1986, pp. 1729–1746.

Alexander Jenkins, *Materials Used in Semiconductor Devices*, Chap. 4, entitled "Selenium", pp. 49–70.

*Primary Examiner*—Eugene R. LaRoche
*Assistant Examiner*—Benny T. Lee
*Attorney, Agent, or Firm*—Skjerven, Morrill, MacPherson, Franklin & Friel

[57] ABSTRACT

Disclosed is a tunable circuit for an integrated circuit device and a process for making such circuit.

8 Claims, 2 Drawing Sheets

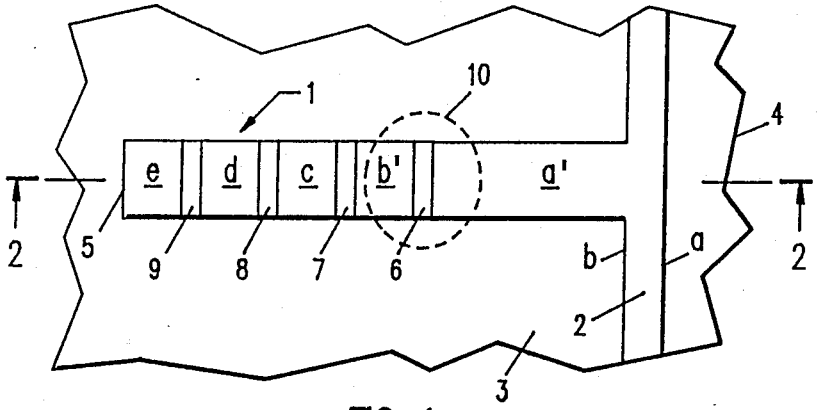
FIG. 1
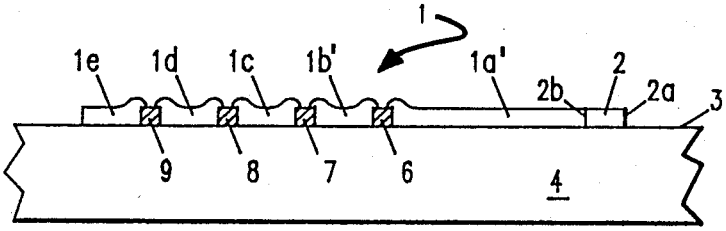
FIG. 2
FIG. 3
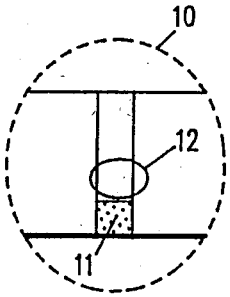
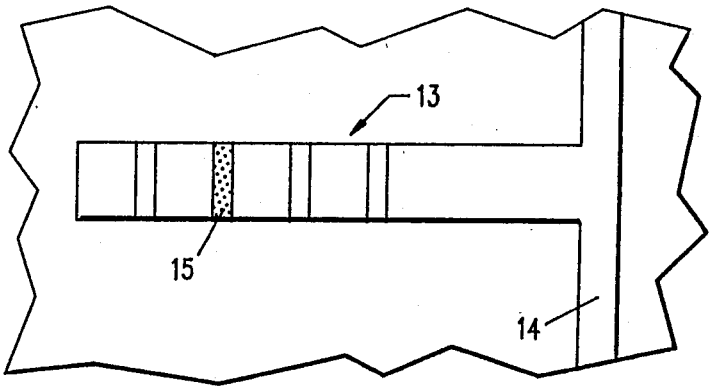
FIG. 4

ON-CHIP TUNING FOR INTEGRATED CIRCUIT USING HEAT RESPONSIVE ELEMENT

BACKGROUND OF THE INVENTION

1. Field of the Invention

This invention relates to the field of tuning electrical circuits and more particularly to the tuning of electrical circuits on an integrated circuit device which includes gallium arsenide microwave devices.

2. Description of the Prior Art

In designing wide band microwave monolithic integrated circuits (MMIC) to achieve a flat frequency response over a wide band (greater than 3:1 bandwidth), the most difficult task is to produce a device with a comparable flat frequency response to that of a hybrid microwave integrated circuit (MIC). In principle, an MMIC should have tighter control of the various parameters than an MIC and therefore should have a flatter and more reproduceable frequency response than an MIC. In practice, however, the lack of accurate design tools and lack of reproduceability of field effect transistor (FET) characteristics require a large number of iterations before a wide band MMIC with a flat response is produced. However, the availability of bond wire tuning and other schemes have made wide band MIC devices with very flat frequency response routinely achievable. To reduce the number of design cycles and to improve the reproduceability of amplifier characteristics for an MMIC device, an on-chip tuning technique is required to achieve wide band performance.

In the field of MMIC devices, several prior attempts at on-chip tuning have been utilized, however, none are totally satisfactory. The first technique which has been used, is a mechanical severing of circuit connections made in air-bridges. For example, such a technique is illustrated in an article titled "MMIC: On-Chip Tunability" published in *Microwave Journal,* in April 1987, pp. 135–139, by Ravender I Goyal and Sarjit S. Bharj. In this article, the authors describe a scheme for tuning which involves having several circuit connections to a device, such as a spiral inductor or a group of capacitors, utilizing an air-bridge which extends above the wafer surface. In tuning a device of this type, based on measured circuit performance, the extra air-bridge connections are disconnected by mechanically scratching open the corresponding air-bridges to eliminate certain portions of the device. The extra air-bridges complicate the layout of the circuit, and most of the tunable connections need not be implemented in air-bridges if circuit topography is the only consideration; however, they are implemented in air-bridges because the suspended structure of the air-bridge is more accessible to mechanical disconnection. These disconnections are performed by an operator peering at the wafer through a microscope and even though care may be used in severing the air-bridge connection, the severed bridge structure can become shorted to other circuit elements causing incorrect circuit operation.

Another technique which has been used to tune a circuit by severing electrical connections which are added for the purpose of eliminating certain portions of a circuit element is the vaporization technique utilizing a laser beam. In the vaporization technique, the connections are "cut" by utilizing the power of the laser beam to vaporize the metal atoms of metallization connections. This has the disadvantage of forming debris on the wafer surface since the vaporized material redeposits on the wafer surface. Also, tuning of a circuit may be accomplished by the laser vaporization of, for example, a portion of an open stub, to change the circuit characteristic of a tuning stub. Again, however, the vaporized material redeposits on the wafer surface as was the case with the "cutting" process. This debris may act as an electrical short and may also lead to undesirable parasitic elements in the MMIC.

A third technique utilized in tuning of electrical circuits in an MMIC device involves a technique called laser assisted chemical reaction. This technique is described in detail in an article entitled "Adjustable Tuning for Planar Millimeter-Wave Circuits", published in the *International Journal of Infrared and Millimeter Waves,* Vol. 7, No. 11, pp. 1729–1746, by Dylan F. Williams, S.E. Schwarz, J.H. Sedlacek and D.J. Ehrlich. In the article, the authors describe three types of tuning methods, all of which utilize tuning by a shorting strip placed across a coplanar wave guide. In each of the three techniques, varying the position of a shorting strip changes the electrical characteristics, permitting circuit tuning. The most practical of the three tuning schemes, from a production standpoint, utilizes a shorting strip which is laser-etched to remove metal from the shorting bar, which is molybdenum. The laser stimulates a local chemical reaction in chlorine which is performed in a vacuum to form a volatile compound. No debris is formed with this technique, however the disadvantage is the need for vacuum and the handling of the corrosive chlorine gas. Another disadvantage of this type of tuning is that it requires that the microwave circuit performance be monitored at the time of tuning which requires microwave feedthrough to the vacuum chamber. In addition, it is very costly, if not impossible, to automatically step in vacuum the microwave probe over an entire wafer.

SUMMARY OF THE INVENTION

It is an object of the present invention to provide on-chip tuning of microwave monolithic integrated circuit devices with a technique which avoids the shortcomings of the prior art. Another object of the present invention is to provide a tunable electrical circuit which may be tuned through the application of heat to a portion of the circuit without removing any material from the circuit. Another object of the present invention is to provide a tunable electrical circuit for connection to a microwave transmission line which may be tuned by the application of heat.

In accordance with the invention, a tunable electrical circuit for connection to a transmission line is provided, comprising: a first electrical conductor having first and second ends and having said first end connected to said transmission line; a second electrical conductor having first and second ends, with said first end of said second electrical conductor positioned in spaced-apart relationship to said second end of said first conductor; and a material capable of having conducting and nonconducting states connecting the first end of said second conductor to the second end of said first conductor.

In accordance with another feature of the present invention, the material utilized in the practice of the abovementioned feature is selenium.

In accordance with another feature of the present invention, a process for forming a tunable electrical circuit on the surface of a solid for connection to a transmission line on said surface is provided, said process comprising the steps of: depositing a strip of material capable of having conducting and nonconducting states on said surface adjacent to one edge of said transmission line; depositing a first electrical conductor on said surface between said transmission line and said material with one end of said first conductor contacting said transmission line and the other end of said first conductor contacting said material; and depositing a second electrical conductor on said surface, said second conductor being positioned such that one end contacts said material.

In accordance with yet another feature of the present invention, the immediately preceding process utilizes selenium as the material positioned between said transmission line and the second electrical conductor.

In accordance with another feature of the present invention, a process for providing a tunable electrical circuit between first and second electrical conductors, said tunable circuit including a first circuit means having an input and an output, and having its input connected to said first conductor; a second circuit means having an input and an output, and having its input connected to said first conductor, the process comprising the steps of: connecting said output of said first circuit means to said second electrical conductor with a material which is changeable from an electrically conducting to an electrically nonconducting state responsive to the application of heat; and connecting said output of said second circuit means to said second electrical conductor with a material that is changeable from an electrically conducting to an electrically nonconducting state responsive to the application of heat.

In accordance with yet another feature of the invention, provided is a process for producing a tunable electrical circuit between first and second electrical conductors, said tunable circuit including a first circuit means having an input and an output, and having its input connected to said first conductor; a second circuit means having an input and an output, and having the input connected to said first conductor, comprising the steps of: connecting said output at said first circuit means to said second electrical conductor with a material which is changeable from an electrically nonconducting to an electrically conducting state responsive to the application of heat; and connecting said output of said second circuit means to said second electrical conductor with a material that is changeable from an electrically nonconducting to an electrically conducting state responsive to the application of heat.

BRIEF DESCRIPTION OF THE DRAWINGS

Other objects and advantages of the invention will become apparent from a study of the specification and drawings in which FIGS. 1 through 4 illustrate one embodiment of the present invention for an open stub tuning circuit;

DETAILED DESCRIPTION OF THE PREFERRED EMBODIMENTS

Figure 5A:
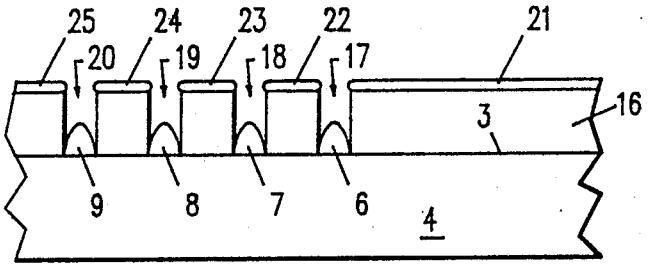
FIGS. 5*a* through 5*c* illustrate a process for producing the open stub tuning circuit illustrated in FIGS. 1–4.

In the present invention selenium is utilized to provide electrical connection between tunable elements of an MMIC. A laser beam stimulates the local transformation of conductive selenium into a vitreous form of insulating selenium to open the circuit of the selected path which is desired to be opened for the purposes of tuning the electrical circuit. Utilizing this tuning process eliminates the debris which was formed by the vaporization techniques of the prior art and in addition relatively low laser power density is required due to the low transformation temperature required to change selenium from a conducting to a nonconducting state. In addition, the vacuum equipment utilized in the prior art technique of laser-assisted chemical reaction is also not required. In addition, tuning can be easily automated by stepping the wafer under a laser beam and real time tuning performed on every die on the wafer by using a standard automatic probe station. Additionally, the tunable elements do not need to be suspended above the wafer surface as is the case with the prior art air-bridge technique and therefore the layout of the circuit is not complicated by the requirement that unnecessary air-bridges be produced.

One of the tuning elements frequently utilized in microwave circuitry is the tuning stub, which tunes the circuit through the change of length of the stub. Referring to FIG. 1, an open stub of the type typically utilized in microwave circuits is illustrated, the stub being indicated by reference character 1. Tuning stub 1 is connected to microstrip 2, having edges a and b. Microstrip 2 and tuning stub 1 are deposited on the surface 3 of wafer 4. In tuning a microwave circuit with an open stub, it is standard to vary the length of the stub, which in FIG. 1 is from the edge b of microstrip 2 to the end of stub 1, being indicated by reference character 5. To tune stub 1 in accordance with the present invention, stub 1 has been divided into subportions a′, b′, c, d and e. The junctions between these subdivided sections of tuning stub 1 have placed therebetween selenium strips 6, 7, 8 and 9. For the tuning of stub 1, such is accomplished by changing selenium strips 6, 7, 8 or 9 from their normally conducting to their nonconducting state by the application of heat. As deposited and processed, which will be described more fully hereinafter, selenium strips 6, 7, 8 and 9 are in a conductive mode, hence the effective length of stub 1 extends from edge b of microstrip 2 to end 5, the end of tuning stub 1. To tune a device such as illustrated in FIG. 1, a laser beam is directed to the selenium strip which is desired to be changed from conducting to nonconducting and by application of heat, generated by the laser beam the selenium is changed from its hexagonal form (which is conducting) to its vitreous form (which is insulating).

FIG. 2 illustrates in cross section, taken along the lines 2—2 of FIG. 1, tuning stub 1 and microstrip 2 shown in FIG. 1. Selenium sections 6–9, as seen in FIG. 2, are deposited on surface 3 and thereafter microstrip 2 and subsections 1*a*′, 1*b*′and 1*c* are deposited on surface 3 to complete the tuning stub circuit. The details and techniques utilized to deposit the selenium sections 6–9, microstrip 2, and tuning stub 1 will be described in detail hereinafter with respect to FIGS. 5*a* through 5*c*. FIG. 2, however, illustrates the cross section of a portion of wafer 4 for the purposes of visualizing the physical layout of the circuit.

FIG. 3 is a top plan view, in highly exaggerated and magnified form, of the area indicated at 10 in FIG. 1. The process utilized to change selenium strip 6 from its conducting to nonconducting state is as follows. The laser beam is positioned on the strip 6 and focused to a spot of approximately 5–10 microns in diameter. After heating the selenium at that location to a temperature of greater than 217° C., this spot cools down rapidly to below 150° C. after the beam is quickly moved to an adjacent equally-sized area, and by successively stepping across selenium strip 6, the material is changed from its hexagonal form to a vitreous form in which it is an effective insulator, thus shortening stub 1 to an effective length of from selenium strip 6 to edge b of microstrip 2. In FIG. 3 the changed nature of selenium strip 6 from conducting to nonconducting state is indicated at area 11. Circle 12 in FIG. 3 represents the focus of laser beam on strip 6, and this is of course highly magnified for explanation purposes.

FIG. 4 illustrates a tuning stub 13 on microstrip 14 which has been changed and adjusted to a length required by changing selenium area 15 from a conducting to a nonconducting state by the application of heat in the manner described above. Thus it will be appreciated that a circuit may be tuned by providing selenium in strips, or other suitable configurations, which when deposited in a conducting state may be changed to a nonconducting state by the application of heat. Another material suitable for this type of implementation is tellurium. Those skilled in the art will no doubt recognize other materials which exhibit a similar characteristic and which may be utilized for tuning circuits by changing from conducting to nonconducting or from a nonconducting to a conducting state by the application of heat.

Turning to FIG. 5, the process for producing microstrip 1 is illustrated. Particularly referring to FIG. 5*a*, wafer 4 has deposited on surface 3 photoresist 16 which is patterned by a conventional photolithographic process to provide openings 17, 18, 19 and 20. Photoresist 16 may be, for example, AZ4110 which is available from American Hoechst Corp., 3070 Highway 22 West, Somerville, New Jersey, 08876. Following the deposition of photoresist 16 and the patterning to provide openings 17–20 in photoresist 16, selenium of approximately 5000 Å is deposited by evaporation in a vacuum chamber and forms strips 6–9, as well as forming deposits 21 through 25 on the top of photoresist 16. Photoresist 16 is then removed by soaking in acetone, leaving selenium strips 6–9 on surface 3.

In the process of deposition of selenium, there are two alternative deposition techniques. The first, and the one preferred, is to deposit the selenium at room temperature, which will result in the selenium being in its vitreous form, which is its insulating state. To bring the selenium to its conductive state, which is the preferred mode utilized in practicing the invention since the laser beam is utilized to change selenium from conducting to nonconducting, it is necessary to bring the selenium to a temperature of approximately 200° C. and retain it at that temperature for approximately three hours in order to convert it to its hexagonal/conducting form.

The alternative deposition technique is to evaporate and deposit the selenium on a substrate which has been heated to 200° C. and then cool the combination slowly in vacuum (for example, at a rate less than 10° C./min). Using this procedure, resist 16 in FIG. 5*a* would be a polyimide film such as XU284 which may be obtained from a source such as Ciba-Geigy, Resin Department, Ardsley, New York, 10502.

Figure 5B:
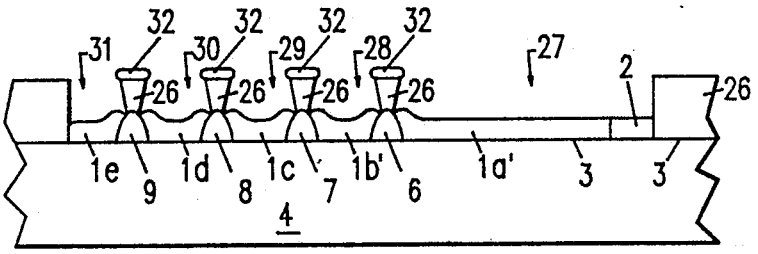
Figure 5C:
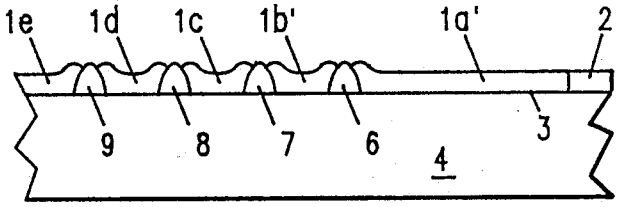

Following the formation of the conductive selenium strips as outlined above, a layer of photoresist 26 is applied over surface 3 and selenium strips 6–9. Thereafter, photoresist 26 is patterned to provide openings 27 through 31. Following the patterning to produce openings 27–31, a metallic tuning stub material, which comprises a Cr layer having a thickness of approximately 1000 Å and an Au layer having a thickness greater than 1 μm is deposited by evaporation. As is conventional with vapor deposition of material, such as Au/Cr, the material also deposits on the upper surface of photoresist 26 which is indicated in FIG. 5*b* at 32. Following the deposition of tuning stub sections 1*a*', 1*b*' and 1*c* through 1*e* and microstrip 1, photoresist 26 is removed by a conventional lift-off process involving the utilization of an acetone soak. In this step photoresist 26 may be, for example, AZ4350 which may be obtained from American Hoechst Corp., 3070 Highway 22 West, Somerville, New Jersey, 08876. The completed microstrip 2 and tuning stub 1 are illustrated in FIG. 5*c*.

There are two modes of tuning devices such as the type utilizing an open stub or other circuit elements tunable by changing the material from conducting to nonconducting or from nonconducting to conducting which may be utilized on a total wafer scale. The first tuning mode involves the selection of a few dies on the wafer which are tuned and characterized for their microwave performance and in so doing an optimum set of selenium joints are turned into an insulator and this data is utilized to tune the remaining dies on the wafer without performing a circuit performance measurement on those devices. In this manner the initial set on which performance is measured for tuning is utilized as the standard set against which the remaining dies on the surface of the wafer are characterized.

A second mode of tuning, which is referred to as real-time tuning, that is, each die on the wafer is characterized and tuned to provide the best performance for each die.

Figure 6:
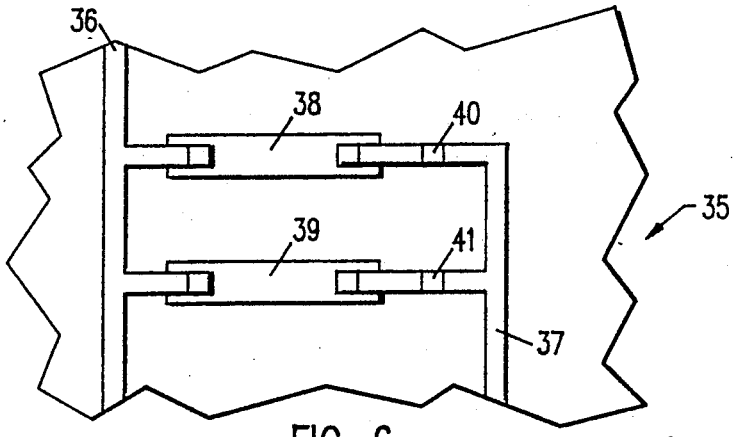
FIG. 6 illustrates a second embodiment of the present invention for tuning an electrical circuit.

The first embodiment of the present invention was illustrated above with respect to an open stub tuning, however it will be appreciated by those skilled in the art that the invention is not limited to a tuning circuit for an open stub. For example, utilizing the present invention, circuits may be changed by the laser application of heat to joints to change them from conducting to nonconducting or from nonconducting to conducting and to change ,a circuit to provide the optimum performance. For example, referring to FIG. 6 tunable circuit 35 is implemented using the present invention. Included in circuit 35 are electrical conductor 36 and electrical conductor 37 which form a desired circuit path for tuning to optimize the performance of a device in which tunable circuit 35 is utilized. For example it may be desirable to have one of several impedance levels exhibited between conductor 36 and conductor 37, and this may be achieved by the implementation of a circuit incorporating resistive elements 38 and 39, each having one end connected to conductor 36, and a second end connected to conductor 37 through selenium joints indicated at 40 and 41. It will of course be appreciated that by utilizing tunable circuit 35, by utilizing the heating of selenium joint material 40 and/or 41 the circuit characteristics between conductor 36 and 37 may be changed by modifying the selenium joint material from a conducting to a nonconducting state or from nonconducting to a conducting state. It will of course also be appreciated that this is a more desirable tuning technique than either the air-bridge or laser vaporization technique and as noted earlier does not require the vacuum which is necessary for a laser-assisted chemical reaction process.

It will of course be appreciated that the foregoing is merely illustrative of two embodiments of the present invention and to those skilled in the art to which the invention relates many variations will become apparent without departing from the spirit and scope of the invention. It is of course also understood that the scope of the invention is not determined by the foregoing description but only by the following claims.

I claim:

1. An electrical subcircuit for connection to a transmission line which is included in an electrical circuit, said subcircuit providing a means to tune said electrical circuit, said subcircuit, comprising:

a first electrical conductor having first and second ends and having said first end connected to said transmission line;

a second electrical conductor having first and second ends, with said first end of said second electrical conductor positioned in spaced-apart relationship to said second end of said first conductor; and a material capable of having conducting and nonconducting states which are changed in response to the application of the heat, connecting the first end of said second conductor to the second end of said first conductor whereby in response to the application of sufficient heat to said material to change the conductive state of said material, the resulting change in the electrical length of said subcircuit functions to tune said electrical circuit.

2. The circuit of claim 1, wherein said material is selenium.

3. The circuit of claim 2, wherein said first and second conductors are comprised of Au/Cr layers.

4. The circuit of claim 3, wherein said first and second conductors have a rectangular cross-section.

5. A process for providing a tunable electrical circuit between first and second electrical conductors, said tunable circuit including a first circuit means, which exhibits a predetermined electrical characteristic, said first circuit means having an input and an output, and having its input connected to said first conductor;

a second circuit means which exhibits a predetermined electrical characteristic, said second circuit means having an input and an output, and having its input connected to said first conductor, comprising the steps of:

connecting said output of said first circuit means to said second electrical conductor with a first mass of material which is changeable from an electrically conducting to an electrically nonconducting state in response to the application of heat; and connecting said output of said second circuit means to said second electrical conductor with a second mass of material that is changeable from an electrically conducting to an electrically nonconducting state in response to the application of heat whereby the first circuit means and second circuit means may each be selectively disconnected from said second electrical conductor to thereby produce a change in the electrical characteristics exhibited between said first and second electrical conductors to thereby achieve tuning.

6. The process of claim 5, wherein said first mass of material connecting the output of said first circuit means to said second electrical conductor and said second mass of material connecting the output of said second circuit means to said second electrical conductor are both selenium.

7. A process for providing a tunable electrical circuit between first and second electrical conductors, said tunable circuit including a first circuit means which exhibits a predetermined electrical characteristic, said first circuit means having an input and an output, and having its input connected to said first conductor; a second circuit means which exhibits a predetermined electrical characteristic, said second circuit means having an input and an output, and having the input connected to said first conductor, comprising the steps of:

connecting said output at said first circuit means to said second electrical conductor with a first mass of material which is changeable from an electrically nonconducting to an electrically conducting state in response to the application of heat; and connecting said output of said second circuit means to said second electrical conductor with a second mass of material that is changeable from an electrically nonconducting to an electrically conducting state in response to the application of heat whereby the first circuit means and second circuit means may each be selectively connected to said second electrical conductor to thereby produce a change in the electrical characteristics exhibited between said first and second electrical conductors to thereby achieve tuning.

8. The process of claim 5, wherein said first mass of material and said second mass of material are changeable from an electrically conducting to an electrically nonconducting state in response to the successive application of heat to portions of said material to change said material from an electrically conducting to an electrically nonconducting state.

* * * * *